United States Patent [19]

Baird et al.

[11] 4,186,055

[45] Jan. 29, 1980

[54] COKE OVEN DOOR

[75] Inventors: William R. Baird, Sturgis; Kenneth O. Sutton, Morganfield; Billy C. Baird, Sturgis, all of Ky.

[73] Assignee: Saturn Machine & Welding Co., Inc., Sturgis, Ky.

[21] Appl. No.: 918,834

[22] Filed: Jun. 26, 1978

[51] Int. Cl.[2] ..... C10B 25/06; C10B 25/16

[52] U.S. Cl. ..... 202/248; 202/241

[58] Field of Search ..... 202/247, 241, 242, 248; 122/498; 49/485, 496

[56] References Cited

U.S. PATENT DOCUMENTS

| | | | |
|---|---|---|---|
| 491,769 | 2/1893 | Clark | 202/247 |
| 2,338,675 | 1/1944 | Van Ackeren | 202/248 |
| 2,744,858 | 5/1956 | Homan | 202/248 |
| 2,965,550 | 12/1960 | McClure | 202/248 |
| 3,032,483 | 5/1962 | Van Ackeren et al. | 202/248 |
| 3,149,615 | 9/1964 | Forsans | 122/498 |
| 3,875,018 | 4/1975 | Calderon | 202/248 |
| 3,881,995 | 5/1975 | White, Jr. | 202/248 |
| 3,984,310 | 10/1976 | Calderon | 202/248 X |
| 4,002,537 | 1/1977 | Calderon | 202/242 X |
| 4,067,778 | 1/1978 | Van Ackeren et al. | 202/248 |

FOREIGN PATENT DOCUMENTS

| | | | |
|---|---|---|---|
| 708676 | 5/1954 | United Kingdom | 202/248 |

*Primary Examiner*—Michael S. Marcus

*Attorney, Agent, or Firm*—Clarence A. O'Brien; Harvey B. Jacobson

[57] ABSTRACT

A coke oven door construction, adaptable for either the pusher side or the coke side of the oven, has a diaphragm arranged so as to exert an even pressure all around the door and associated jamb when the door is locked in the jamb by a suitable locking device. After the door has been locked in place, air is connected to the bottom of the door so as to permit injection of a mixture of air and a suitable anti-stick agent all around the door diaphragm and onto the sealing surface of the associated jamb. The anti-stick agent keeps carbon and other foreign matter from sticking to the diaphragm and jamb surfaces. Further, if a fire occurs between the sealing surfaces, it can be extinguished by connecting the air to the doors. The air mixed with the anti-stick agent is preferably preheated before it reaches the jamb surface so as to prevent warping of the jambs. In addition, to eliminate vertical warping of the door, the frame of the door is made flexible in the middle thereof, and the flexible portion of the frame is spring loaded so as to hold the frame straight until the jamb moves inboard or outboard of the frame. If the jamb does move, the door seal will move with it keeping the same pressure on the seal at all times.

9 Claims, 13 Drawing Figures

COKE OVEN DOOR

BACKGROUND OF THE INVENTION

1. Field of the Invention

This invention relates generally to coke oven doors, and particularly to coke oven doors which assure a good seal between the door and jamb, and which are constructed so as to prevent warping of the door and/or jamb during operation of the associated oven.

2. Description of the Prior Art

Coke ovens are conventionally provided with two doors at any given site, one side of the oven being called the coke side and the other side being called the pusher side. The pusher side door has a small door or hatch covering an opening provided in the top end of the door, this small door hatch generally being designated as a "leveler door". The coke side door is a flush door without any other openings.

A difficulty encountered with these doors is that carbon and other foreign matter get between the door and assoicated jamb surface of the oven and cause sticking of the abutting door and jamb surfaces. Also, in addition to sticking, the accumulation of carbon and other foreign matter creates a fire hazard.

Another problem encountered with coke oven doors is that the door tends to warp in the shape of chair rocker, with the middle of the door seal touching the sealing surface of the associated jamb and pulling away from the jamb sealing surface at the top and bottom thereof. As a result of such warping, as well as the difficulty of achieving tight seals between the door and jamb, one of the greatest problems encountered today at coke oven sites is leakage of smoke and gas at the doors. In addition, there is a problem with leakage of flame up the sides of doors causing warpage of jambs and buck stays. This damage is very costly and is a great cause of air pollution.

Various proposals have been made for improving the seal between a coke oven door and its associated door jamb. For Example, U.S. Pat. No. 890,175, issued June 9, 1908, to H. Ries, discloses a furnace door provided with a plurality of pressure springs adjustable by associated bolts to vary the pressure over the surface of a door plate of the oven door. The knife edge which provides the seal of the Ries device, however, is of the same general kind as used on sealing edges of oven doors today, with this knife edge running all around an associated packing ledge and being compressed by the aforementioned pressure springs. The latter are equally spaced between upper and lower knife edges, but the spaces between the spring spaces tend to become disfigured, and there is a possibility of leaks along the knife edge when same has been subjected to heat for a substantially length of time. That is, the knife edge arrangement as disclosed in the Ries patent operates well until heat and age cooperate to disfigure the entire knife edge, and then no further adjustment can be made to the sealing edge to achieve a good seal.

U.S. Pat. No. 2,442,348, issued June 1, 1948, to R. E. Exum, discloses a self-sealing coke oven door which is also similar to the construction commonly used today. When the sealing edge of this arrangement makes sealing contact with jamb sealing surfaces, it makes contact in a similar manner to placing a straight edge on the edge thereof on any flat surface. On the machine sealing surface of the jamb, hard carbon will build up in places and this kind of seal will not penetrate the carbon, leaving leakage between the areas of carbon build-up. The sealing edge is compressed by a bolt which is supported by a main frame, making this arrangement a fixed seal. When this fixed seal is under pressure from associated springs, that is to say when there is warpage of the associated jamb or of the door frame, an undesirable adjustment of the associated adjustment bolts must be made in the field. These adjustment bolts are either over adjusted or under adjusted, causing a leak to occur at some other location around the sealing edge. Further, both the frames of U.S. Pat. Nos. 890,175 and 2,442,348 are rigid frames, which means that when the frame becomes warped and can be adjusted no further by the adjusting bolts, the frame must be either straightened or replaced. In particular, the frame disclosed in U.S. Pat. No. 890,175 has a tendency to bow outward from the heat of the oven while the associated jamb has a tendency to bow inwardly. This occurs in all coke oven batteries. After some time of use, this type of door frame and sealing edge run out of adjustment and have to be repaired or replaced. Further, there are some undesirable friction points in this general mode of construction.

U.S. Pat. No. 3,881,995, issued May 6, 1975, to H. A. White, Jr., discloses a method and apparatus for sealing a coking chamber in which the sealing edge is similar to the other sealing edges used today. The White proposal adds a member which makes the sealing edge a wider sealing surface, but this kind of seal is sometimes too wide to penetrate carbon left on the sealing surfaces of the associated jamb. Further, the frame of U.S. Pat. No. 3,881,995 is rigid, as are those discussed above, while a leveler door disclosed in U.S. Pat. No. 3,881,995 is generally the same as those commonly used today, except for the addition of a cover. The use of this cover works well until the associated door becomes warped, and then leakage will occur by the cover.

U.S. Pat. No. 3,984,310, issued Oct. 5, 1976, to A. Calderon, discloses an apparatus for minimizing accumulation of deposits between the door and associated jamb of a coke oven in which a burner is provided at the edge of the door in order to burn off any deposits lying between the door and the door jamb. The sealing edge of this apparatus is generally the same as sealing edges commonly used today. The burners have been applied to burn off carbon and other matter by means of a combustible mixture installed in the door frame or in the door jamb, as desired. Further, U.S. Pat. No. 3,875,018, issued Apr. 1, 1975, also to A. Calderon, discloses a coke oven door provided with a heat settable sealant for forming a positive seal between the door and the jamb of an oven in order to plug the crevices through which gas might otherwise escape. The latter mentioned prior patent actually brings out quite clearly the difficulties encountered with trying to obtain a tight seal between a door and associated jamb using the door constructions commonly used today.

U.S. Pat. No. 3,149,615, issued Sept. 22, 1964, to P. E. Forsans, discloses a vaporizing jamb frame for oven doors wherein steam fills a sealing chamber provided between the door and jamb and insures the tightness of the oven door, while U.S. Pat. Nos. 144,857, issued Nov. 25, 1873, to P. Munzinger, and 491,769, issued Feb. 14, 1893, to J. P. Clark, disclose examples of tight-fitting covers for retorts.

SUMMARY OF THE INVENTION

It is an object of the present invention to provide a leak-proof seal between the diaphragm seal of a coke oven door and a jamb of the coke oven.

It is another object of the present invention to provide a coke oven door having a sealing arrangement which includes a device for preventing the build up of carbon and other foreign matters on a sealing diaphragm of the door and on the associated surfaces of the jamb of the oven.

Yet another object of the present invention is to provide a coke oven door which, if the associated oven jamb moves or buckles under the effects of heat applied to the jamb, the seal of the oven door will move with the jamb, thus exerting a constant pressure on the seal at all times and assuring maintenance of a tight seal entirely around the oven door.

These and other objects are achieved according to the present invention by providing a coke oven door having: a main frame; and a sealing assembly mounted on the main frame for providing a tight, uniform and non-sticking set between the main frame and an associated oven door jamb. The sealing assembly includes a sealing knife edge element mounted on the main frame and arrangeable coextensive with the associated door jamb, and a support arrangement also mounted on the main frame of the door for exerting a uniform bias along an entire extent of the sealing knife edge. This support arrangement includes a sealing edge support member anchored to and extending away from the main frame and connected to the sealing knife edge element adjacent a free end thereof. The sealing knife edge element is arranged to make contact with the associated surface of the doorjamb at an angle, for example, approximately 25°. When the associated door is locked in place on the oven, by a conventional locking device known per se, a sealing edge of the sealing knife edge element is compressed against the doorjamb to achieve the desired seal.

The sealing assembly advantageously further includes a dispensing arrangement for distributing a mixture of a anti-stick agent and air to all inner surfaces of the sealing knife edge element and associated jamb.

The main frame of a coke oven door according to the present invention preferably includes a diaphragm extending around a periphery of the main frame and partially overlapping the support member of the sealing assembly. This diaphragm advantageously is a substantially rectangular framework constructed from a resilient material so as to be flexible in the middle of the longitudinal extent of the door, with a resilient assembly being disposed in such middle of the door and loaded in such a manner as to eliminate the necessity of adjustments in the field after the door is in place on site. By this arrangement, as the associated doorjamb bows inwardly as by the application thereon of heat from the oven, the frame of an oven door according to the invention will travel with such bow. Thus, a tight seal will be maintained completely around the oven doorway. More specifically, the frame for an oven door according to the present invention has, for example, six high pressure points, with one each being at each top corner radius and one each being at each bottom corner radius of the sealing edge. The other two pressure points are one to each vertical side and are formed by locking devices of conventional construction and as commonly employed on coke oven doors.

The present invention also contemplates applying the frame construction as discussed above to the leveler door of the pusher side door as commonly employed with a coke oven.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
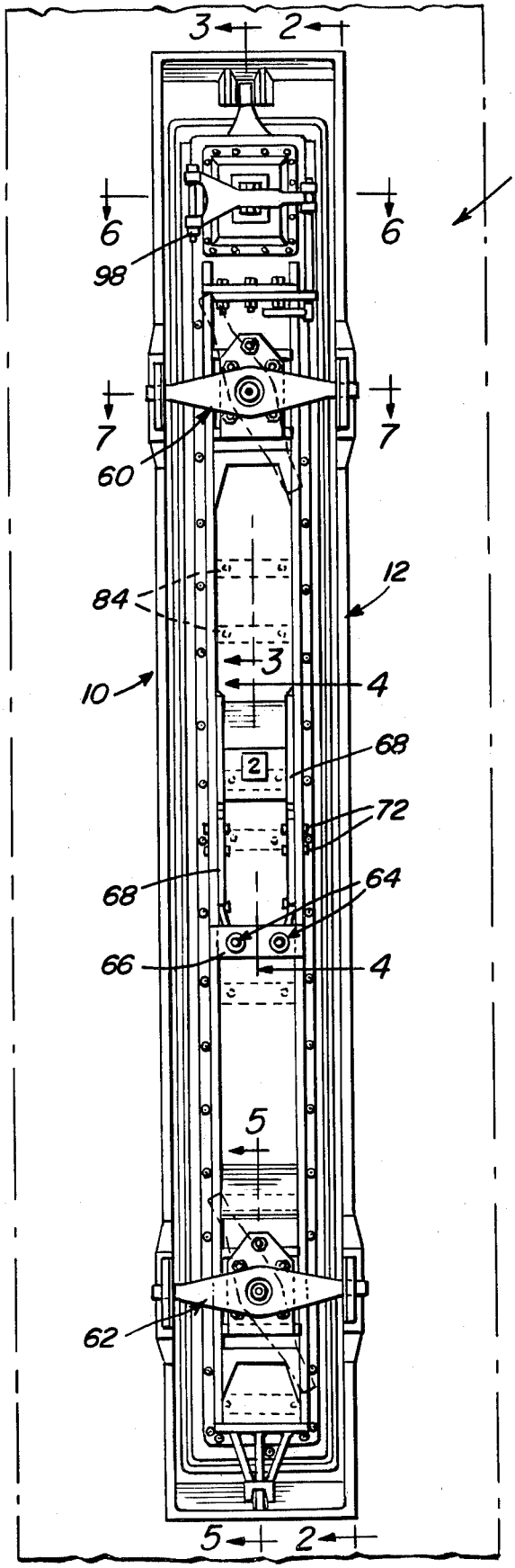
FIG. 1 is a partly schematic, fragmentary, front elevational view showing a pusher side door constructed in accordance with the present invention and disposed in the pusher side doorway of a coke oven.
Figure 2:
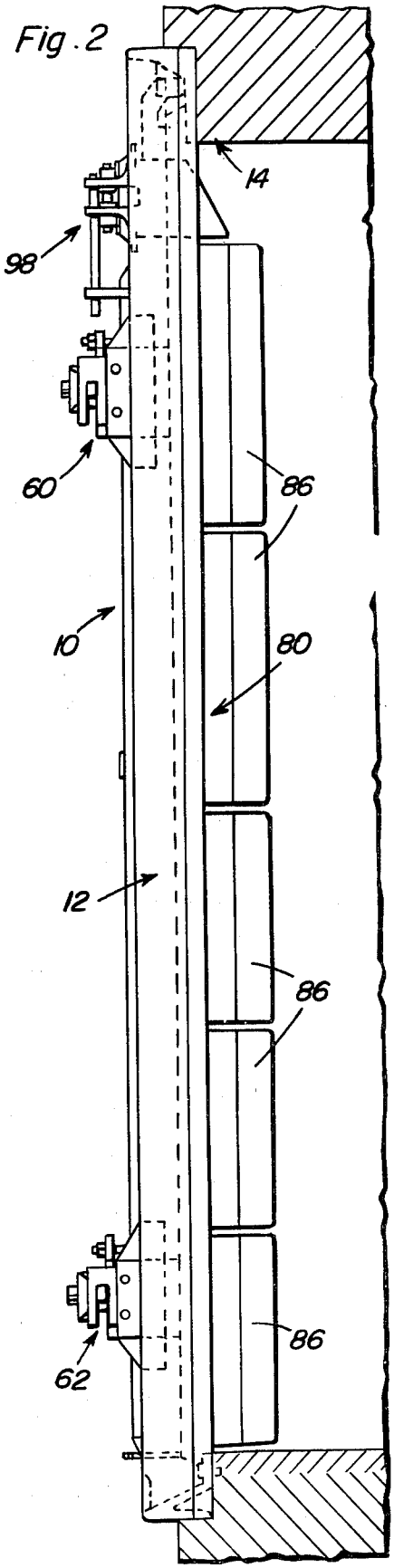
FIG. 2 is a fragmentary, vertical sectional view taken generally along the line 2—2 of FIG. 1.
Figure 3:
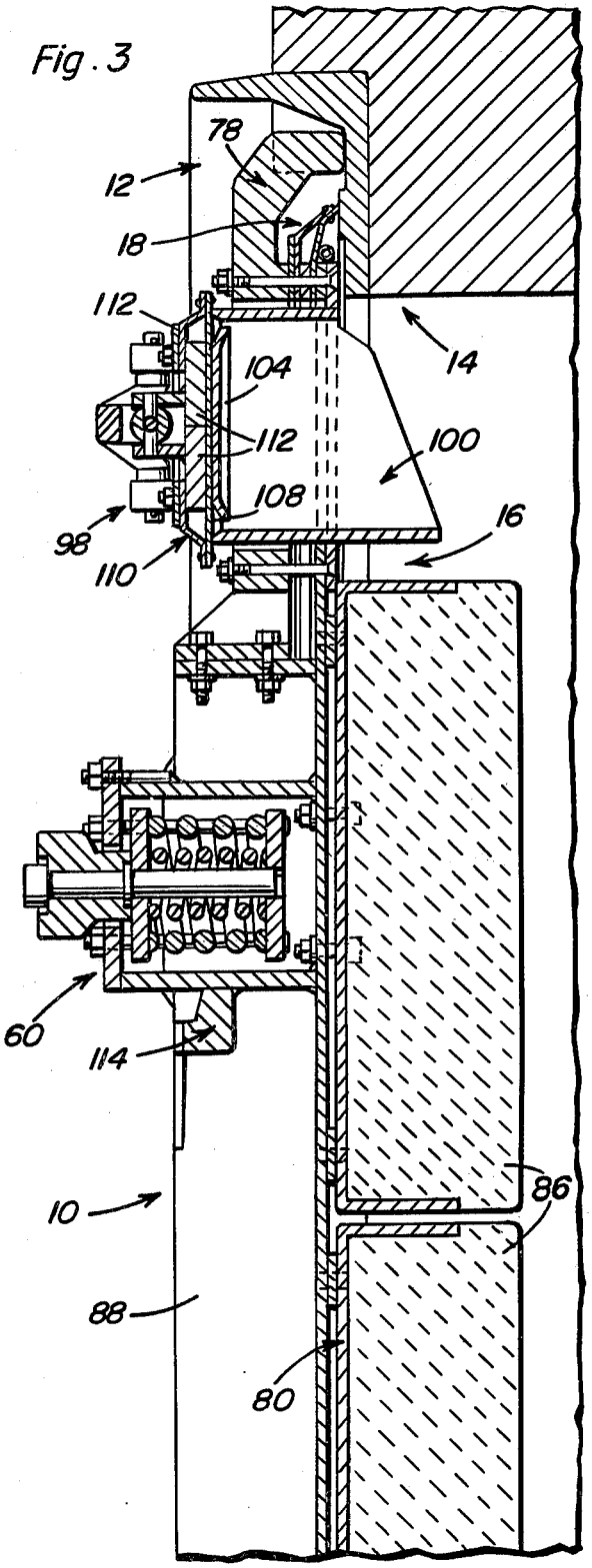
FIG. 3 is an enlarged, fragmentary, sectional view taken generally along the line 3—3 of FIG. 1.
Figure 4:
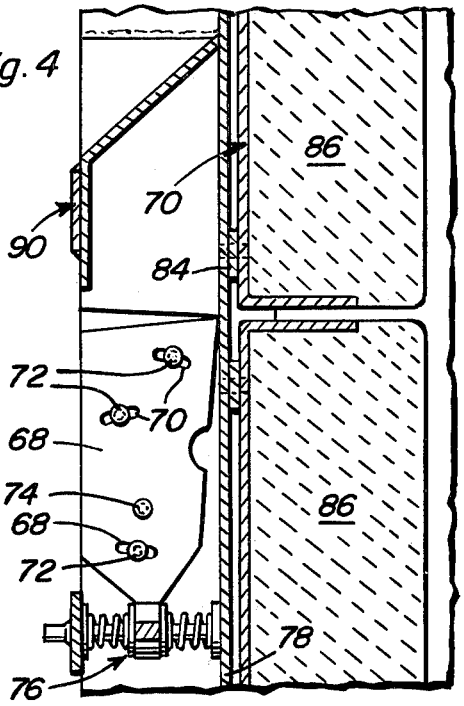
FIG. 4 is an enlarged, fragmentary, sectional view taken generally along the line 4—4 of FIG. 1.
Figure 5:
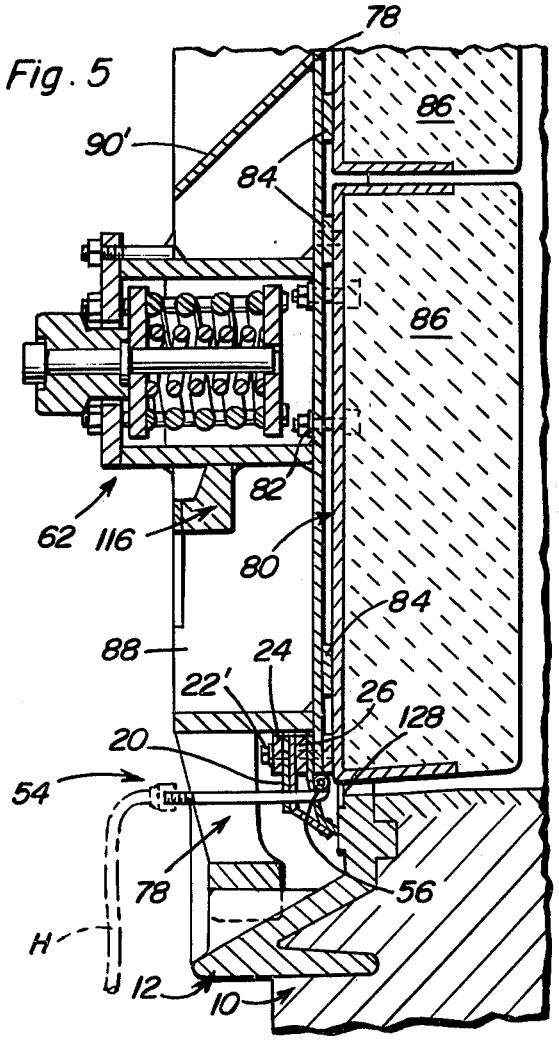
FIG. 5 is an enlarged, fragmentary, vertical sectional view taken generally along the line 5—5 of FIG. 1.
Figure 6:
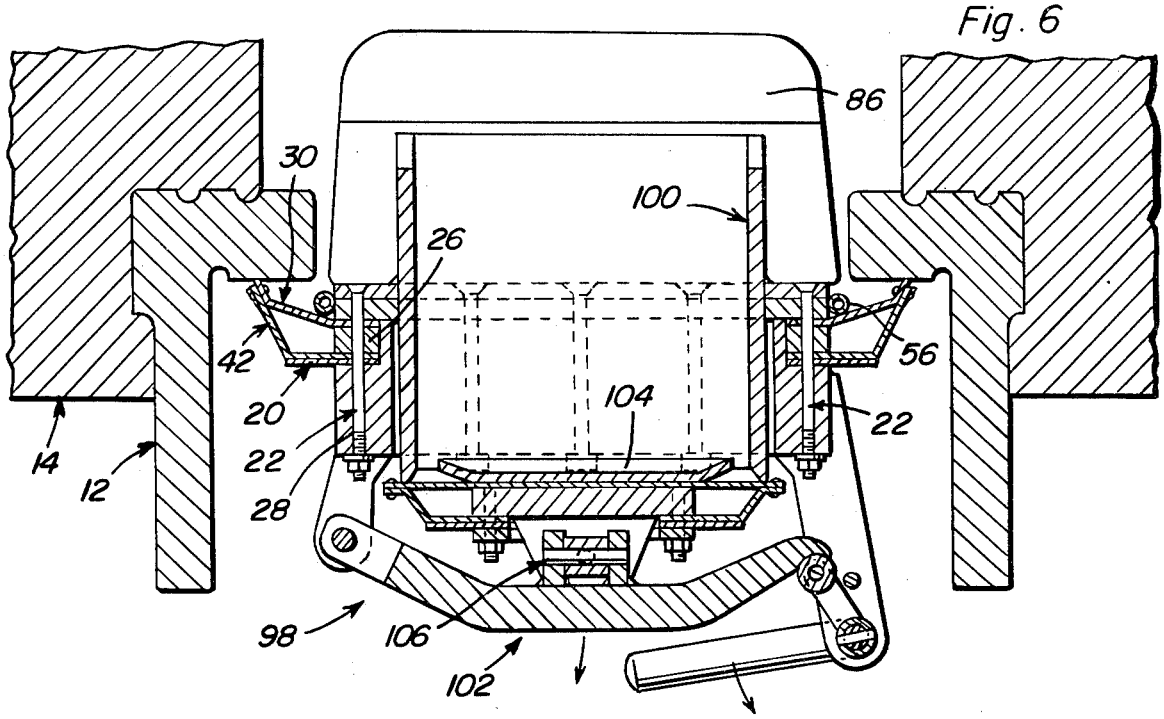
FIG. 6 is an enlarged, fragmentary, horizontal sectional view taken generally along the line 6—6 of FIG. 1.

Referring now more specifically to FIGS. 1 through 10 of the drawings, a pusher side, coke oven door 10 according to the present invention is illustrated as lockingly engaged in the pusher side oven door jamb 12 of a conventional coke oven 14, and the like. Door 10 includes a main frame 16 having mounted thereon a sealing assembly 18 arranged for providing a tight, uniform and non-sticking set between the main frame and associated oven door jamb 12.

Extending around a periphery of the substantially rectangular main frame 16 is a diaphragm 20 retained by a plurality of bolts 22 and 22' depending upon the vertical location of the bolts, with a bar 24 being disposed between diaphragm 20 and retaining nuts associated with bolts 22, 22'. Suitable spacers 26 and 28, again depending on the specific location along the extent of diaphragm 20, are disposed between diaphragm 20 and associated part of the sealing assembly 18.

Sealing assembly 18 includes a sealing knife edge element 30 mounted on the main frame 16 between spacer bar 24 and one of the spacers 26 and 28 so as to be partially overlapped, but inside of or toward the door from diaphragm 20 so as to form a sealing edge completely around the periphery of frame 16. Extending outwardly away from the oven and partially forming frame 16 is a base plate 32 and a main frame weldment 34 which also includes a pair of substantially coextensive and parallel side plates 36 and 38 spaced from one another transversely of the vertical extent of door 10 and connected together by the base plate 32 and a bottom plate 40 of weldment 34. Sealing assembly 18 further includes a support member 42 mounted on weldment 34 of main frame 16 by the aforementioned bolts 22 and 22' so as to be abutted and partially overlapped by diaphragm 20. This support member 42 includes a portion 44 angled from an anchor portion 46 thereof which is secured to frame 16 in abutting, coextensive relationship with the adjacent portion of diaphragm 20. Portion 44 approaches the adjacent surface of jamb 12 at a predetermined angle, preferably about 25°, while sealing knife edge element 30 is formed from three portions 48, 50, and 52, disposed at increasing angles with respect to one another as they extend from base plate 32 so that the portion 52, which is the sealing edge of sealing assembly 18 of door 10, approaches the adjacent surface of jamb 12 at approximately the same angle as portion 44 of support member 42. The latter mentioned portions 44 and 52 are connected to one another in a suitable manner, such as by the illustrated rivets.

An anti-stick substance, such as Silifax, mixed with air is projected onto the surfaces of jamb 12 which are engaged by the sealing assembly 18 from a dispensing arrangement 54 including a manifold 56 of rectangular configuration completely surrounding main frame 16. More specifically, manifold 56 is retained against the sides of base plate 32 as by suitable clamps 58 holding manifold 56, which can be a length of conventional tubing provided with a plurality of apertures A, against the inner surface of portion 48 of knife edge element 30. As perhaps can best be seen from FIG. 10, the apertures A of manifold 56 are directed so as to strike the inside surface of sealing edge defining portion 52 of knife edge element 30 and that surface of jamb 12 immediately adjacent portion 52.

A pair of conventional locks 60 and 62, such as manufactured by the Wilputte Corporation and others, are provided in vertically spaced relation on main frame 16 as is conventional so as to lock sealing assembly 18 in sealed relationship with the associated jamb 12 of oven 14.

A spring assembly 64 extends perpendicularly from main frame 16 so as to be anchored at the outward end in a spring bar 66 which itself extends transversely of the vertical length of door 10 between a pair of substantially parallel, transversely spaced rails partially forming main frame 16. Tension on spring assembly 64, which in turn determines the amount of tension on the resilient middle portion of diaphragm 20, is set by use of a pair of plates 68 adjustably mounted by use of slots 70 and a plurality of slip-pins 72 which will clamp plates 68 to the associated rails in a desired position. A hole 74 is provided in each of the plates 68 to receive a shipping lock bolt, not shown, while each of the plates 68 is connected to an associated one of the spike-supported spring assemblies 64 by a collar 76.

The spring assemblies 64 are anchored to a substantially planar midportion of a weldment 78 which forms the principal longitudinally extending member of main frame 16, and which terminates at either end thereof in the usual hook-shaped portions which are received in sockets provided therefor on oven 14 to properly position door 10 relative to the doorway of oven 14 which door 10 is to selectively block.

Fastened to the middle extent of weldment 78 so as to extend into oven 14 are a plurality of retainers 80 secured by bolts 82 in a suitable manner and spaced from weldment 78 by suitable spacer bars 84. These retainers 80 hold the refractories 86 constructed in a conventional manner from a suitable refractory material. The rails that extend along the vertical extent of main frame 16, and which support the spring bar 66, are designated 88 in the drawings, and between these rails 88 are disposed a plurality of dust shields 90 and 90'.

Figure 7:
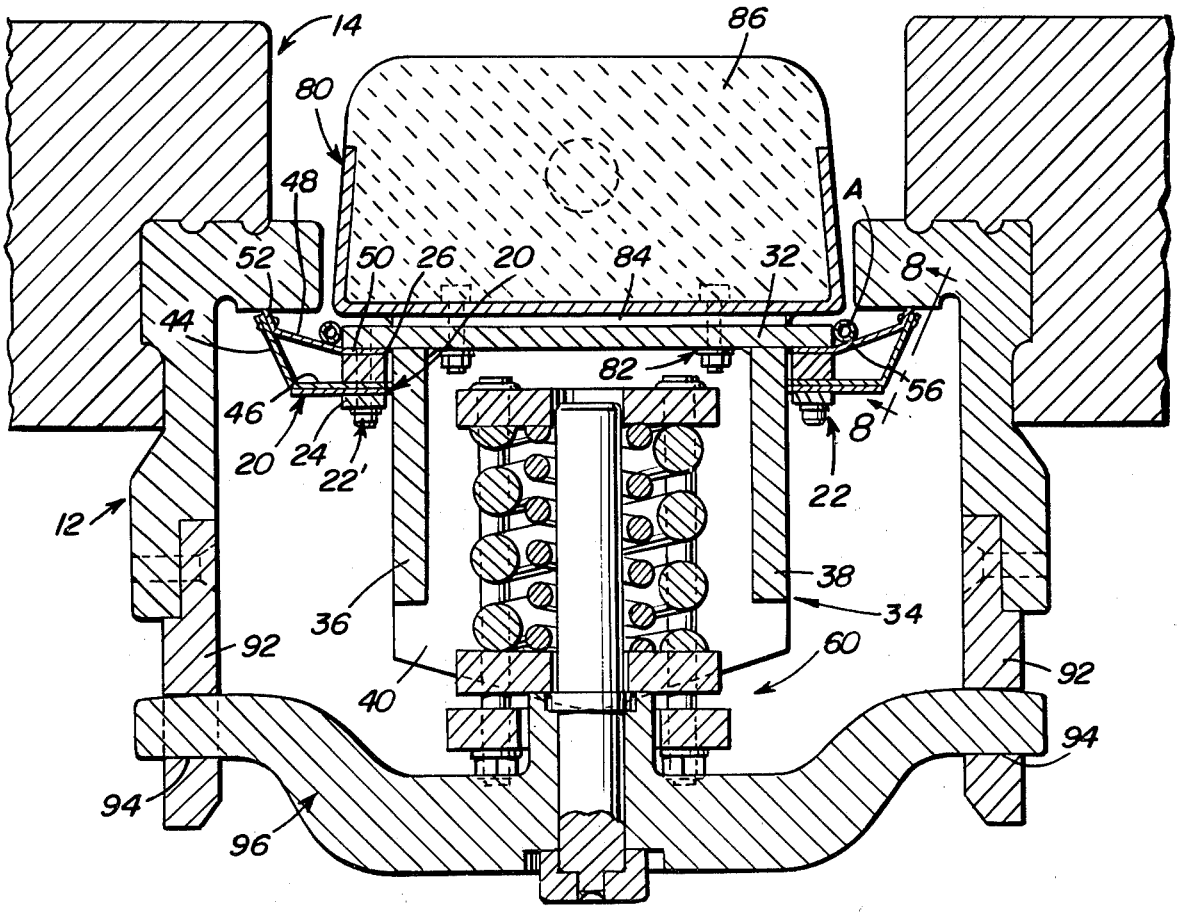
FIG. 7 is an enlarged, fragmentary, horizontal sectional view taken generally along the line 7—7 of FIG. 1.

As can best be seen from FIG. 7, locks 60 and 60', act to lock door 10 to jamb 12 of oven 14 by a pair of brackets 92 and 92' each provided with a respective notch 94 extending in the direction opposite the other of the notches for receiving respective ones of the ends of locking arms 96 rotatably mounted for pivotal movement between a position engaging in notches 94 and a position clear of notches 94. The former is the locked mode, reached by counterclockwise rotation of locking arms 96, and the latter the unlocked mode of each of the locks 60, 60'. A suitable torsion spring, and the like, is associated with each of the locks 60, 60' for biasing the handle 96 toward the locked mode position as seen in full lines in the drawings.

Door 10 is provided with a leveler door 98 disposed in a leveler door open frame 100. Leveler door 98 includes a handle assembly 102 of generally conventional construction, and has a heat shield 104 in the form of a shallow dish disposed on the inner surface of door 98 so as to face the interior of oven 14. Handle assembly 102 includes a locking arrangement and is generally pivotally mounted for rotation in two directions about a trunion 106. By this arrangement, it will be appreciated that door 98 can be swung into and out of a position blocking the opening formed by frame 100 by appropriate pivotal movement of the handle extending beneath and to the right hand side of door 98, the operation of the mechanism of handle assembly 102 being illustrated by direction arrows in FIG. 6.

Leveler door 98 includes a sealing diaphragm 108 disposed in a single plane so as to extend beyond the periphery of the tapered outer edge of frame 100 for forming a tight seal therewith, diaphragm 100 being constructed a deformable material. A support member 110, similar to support member 42, extends downwardly to and engages with the peripheral portions of diaphragm 108 for retaining same in proper position, while a leaf spring 112 partially overlaps support member 110 in a manner similar to the resilient diaphragm 20 and support member 42 for biasing support member 110 toward frame 100. It will be appreciated that the sealing assembly of leveler door 98 is basically the same as sealing assembly 18 of door 10 itself, except that because of the relatively limited extent of door 98, the resilient adjustment of door 10 is not required in door 98. Rather, the frame of door 98 is relatively rigid, being formed by the illustrated pair of metal plates.

Suitable lift lugs 114 and 116 are provided adjacent the locks 60 and 62, respectively, for facilitating lifting of door 10 in a known manner by equipment not shown for placement against jamb 12 and removal therefrom as desired.

Figure 8:
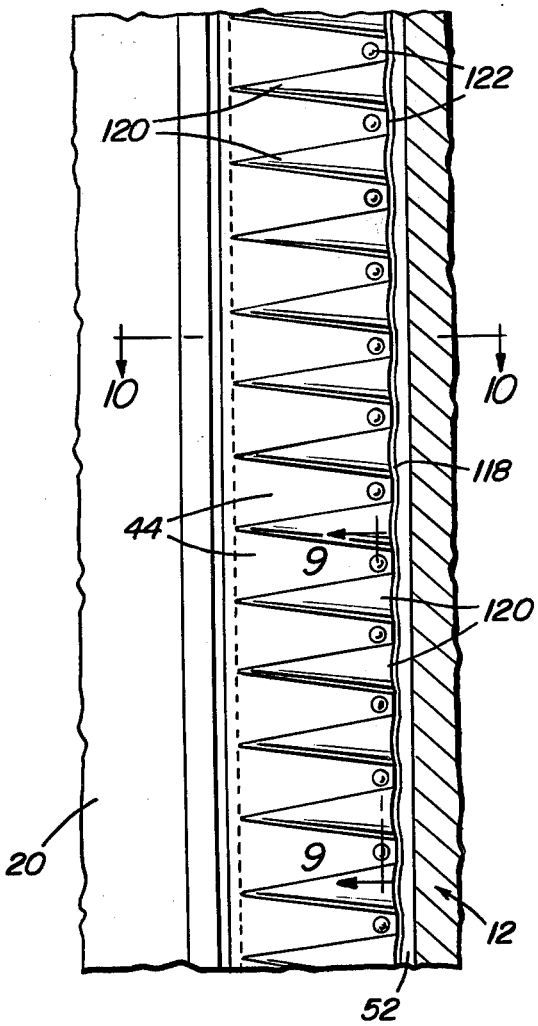
FIG. 8 is an enlarged, fragmentary, sectional view taken generally along the line 8—8 of FIG. 7.
Figure 9:
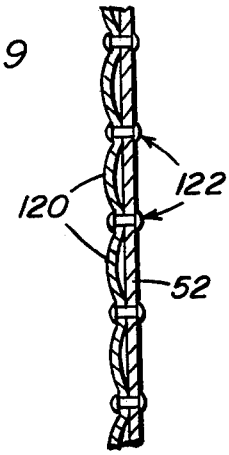
FIG. 9 is a fragmentary, sectional view taken generally along the line 9—9 of FIG. 8.
Figure 10:
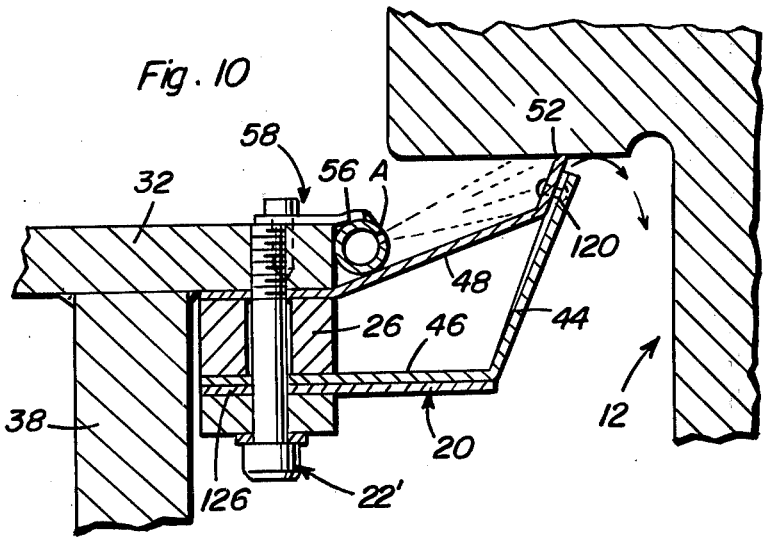
FIG. 10 is an enalarged, fragmentary, sectional view taken generally along the line 10—10 of FIG. 8.

As can best be seen from FIGS. 8, 9 and 10, edge 118 of portion 44 of support member 42 has a ripple or corrugated effect formed by the undulations or corrugations 120. These corrugations 120 also have a configuration in plan approximating an isosceles triangle opening toward edge 118 from adjacent the bend connecting portion 44 of support member 42 to the portion 46 thereof. Suitable rivets 122, and the like, can be disposed between the corrugations 120, the latter of which are bowed away from the portion 52 of edge element 30, for fastening portion 44 to portion 52. The primary purpose of the corrugations 120 is to exert a resilient force against portion 52 and the sealing edge formed thereby.

Figure 11:
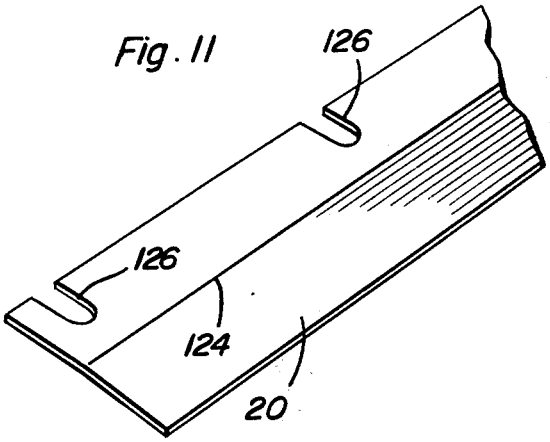
FIG. 11 is a fragmentary, perspective view showing a portion of a diaphragm forming leaf spring for a coke oven door according to the present invention.

Referring now more particularly to FIG. 11 of the drawings, the diaphragm 20, which is actually a longitudinally extending leaf spring, is illustrated. It will be noted that actually diaphragm 20 is formed into two substantially equal longitudinal portions separated by a bend line 124 so that these portions are disposed at a slight angle with respect to one another in order to place a bias on leaf spring 20 and on the portions 46 of support member 42 which leaf spring 20 abuts. Recesses 126 are provided along the inner edge of diaphragm 20 for facilitating anchoring of diaphragm 20 on main frame 16 as by the aforementioned bolts 22 and 22'.

In operation, an operator will hang the pusher side door on a pusher machine door extractor, not shown but known per se, and then align the door 10 with the associated coke oven jamb 12. The door extractor will travel in a horizontal path until the sealing assembly 18 makes contact with the sealing surfaces of jamb 12. At this time, the door extractor will compress the springs in the locks 60 and 62 until the locking arms 96 can be turned into a horizontal positon and locked between the seal surface of jamb 12 and the jamb door locking hooks 92 and 92'. Once the locking arms 96 are engaged in notches 94 of jamb door locking hooks 92 and 92', door 10 will be locked in position and the door extractor will retract in horizontal position to its normal, inoperative position.

Only one person, located at floor level below the bottom of door 10, is needed to connect an outside source of air and an anti-stick agent of suitable mixture to hose H, preferably by a conventional quick coupling device. Now, mixed air and the anti-stick agent can pass into the manifold 56 and out through the apertures A of dispensing arrangement 54 so as to blow away any foreign matter and leave a moist layer of anti-stick agent on the sealing surfaces of sealing assembly 18. Simultaneously with the air and anti-stick agent passing through apertures A of manifold 56, the mixture is also passing through armlets provided in the inlet to manifold 56, located at the bottom of door 10, and through openings 128 provided between jamb 12 and the opposing surface of an adjacent one of the refractory retainers 80 for blowing foreign matter from the surfaces of jamb 12 and leaving thereon a moist layer of the anti-stick agent. Should flame or fire occur along the outer edge of sealing assembly 18, the personnel on floor level below door 10 can reconnect the air and anti-stick agent disposing hose H and extinguish the fire before damage to jamb 12 or to the buck stays occur, or before serious air pollution is caused. By the illustrated arrangement, manifold 56 causes the air and anti-stick agent to be preheated before it reaches the surfaces of jamb 12. Therefore, the jamb 12 is not in danger of being warped by application thereto of cold water or air as are sometimes now used to put out fires at coke oven doors, causing the jambs and buck stays to bend due to the stresses created by uneven heating of these elements.

When door locking pressure is applied to the sealing assembly 18, thus pushing back diaphragm 20, the front sealing edge formed by portion 52 of edge element 30 becomes longer in width, thereby pushing the carbon or other foreign matter having been previously deposited in the seal to the outboard side of the sealing edge and causing a good seal to be realized. Accordingly, a better seal is obtained than with sealing edges which go straight into the jamb sealing surfaces and seal over the high places and miss the low places, thus causing leakage at all low spots.

Stated otherwise, when the sealing edge formed by portion 52 of edge element 30 makes contact with the abutting surfaces of jamb 12 at an angle of, for example, approximately 25°, under a bias from the locks 60 and 62, the sealing edge is compressed against jamb 12 and moves rearwardly, causing the moment of the sealing edge to become longer and sending the entire knife edge element 30 outwardly across the surface of jamb 12 making its own seat on the surface of jamb 12 in the process. This action is similar to that of a suction cup sliding across a surface before it will form a vacuum. The sealing edge is under pressure at all times while same is in contact with the jamb 12. Further, the pressure on the sealing edge is constant per lineal distance of measure all around the sealing knife edge 30, and heat has no effect on the sealing knife edge element 30, leaf spring or diaphragm 20, or the sealing edge support member 42. That is, heat cannot and will not change the shape of these elements. Diaphragm 20 need be replaced only from age. The sealing knife edge element 30, sealing edge support member 42, and diaphragm 20 have four corners with, for example, approximately $4\frac{1}{2}$radius. These four corners are under compression from the leaf spring forming diaphragm 20, and inasmuch as they are 90° turns, the corners will not have as much lead at the corners as will the distance between these corners. Therefore, the four corners are the high pressure points. When the four corners have made compression contact with jamb 12, all remaining lineal distance measurement along the sealing surface has been under compression since element 30 first made contact with the jamb 12; this compression occurring at first along half the distance from each corner.

The main frame 16 of door 10 is not rigid, but rather is made flexible in the middle of the longitudinal extent thereof and is spring loaded so as to eliminate the necessity of adjustments in the field after the door has been put in place in conjunction with a coke oven. As the doorjamb 12 bows inward under the heat from the oven, the frame 16 will travel with the bow, and the maintenance of a seal between the jamb 12 and door 10 will reduce the amount of bowing undergone by the jamb 12.

Figure 12:
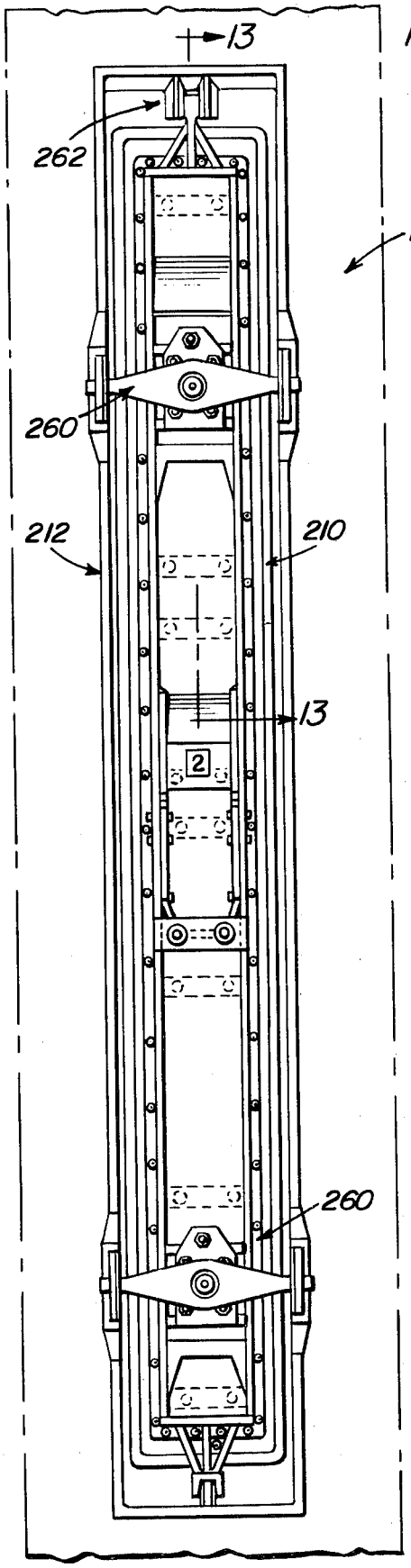
FIG. 12 is a partly schematic, fragmentary, front elevational view, similar to FIG. 1, but showing a coke side oven door according to the present invention.
Figure 13:
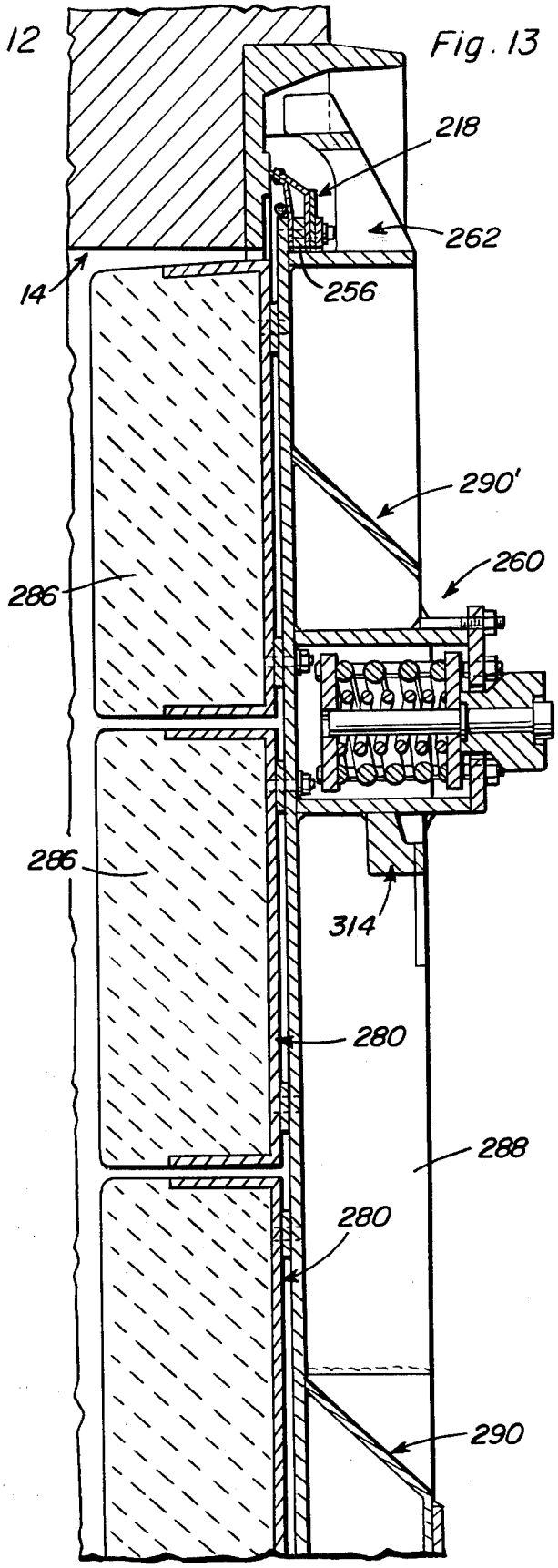
FIG. 13 is an enlarged, fragmentary, vertical sectional view taken generally along the line 13—13 of FIG. 12.

FIGS. 12 and 13 of the drawings illustrate a coke side door 210 for use in conjunction with pusher side door 10 on the coke oven 14. As can be seen from these figures, the coke side door 210 is substantially identical in construction to pusher side door 10, except that the leveler door is eliminated. Accordingly, the various parts of the coke side door 210 have been given the same reference numerals as the identical parts of pusher side door 10, but with a numeral "2" or "3" preceding same.

An operator can hang coke side door 210 on the conventional door extractor or door car (not shown) and use the same procedure of operation as set out above for the pusher side door 10 to place the coke side door 210 in place and subsequently move same as necessary.

As can be readily understood from the above description and from the drawings, use of a coke oven door constructed in accordance with the present invention will eliminate all of the damage and air pollution now commonly encountered due to reduction in warpage of the jamb of the oven, maintenance of a seal between the oven door and the oven jamb even during warpage of the jamb, and the use of a mixture of air and a suitable anti-stick agent for keeping seals and jambs clean. The sealing diaphragm assembly according to the invention should never have to be readjusted after adjustment for a specific jamb when the door is installed. The only special installation needed for use of these doors with conventional ovens would be provision of a large capacity air line below the bottom of the doors on the pusher side and the coke side, and a portable air vacuum pump tank for mixing air with the anti-stick agent in a conventional manner not shown. By inducement of the anti-stick agent to all inner surfaces of the jamb, door seal, and refractory area, no carbon or other foreign matter will stick to the door areas that need to be kept clean. Any matter that is suspended between the jamb, sealing edge, or refractory can and will be blown off by the air mixed with the anti-stick agent. With the use of an anti-stick agent and air, the sealing edge will not become overheated and warp. Further, in the areas where the air and agent are used, the surfaces will remain clean as if new and not used. Using procedures permitted by the coke oven door construction according to the present invention, refractories and jambs is not only the most efficient, but the least expensive of the techniques which can be used today. By using the anti-stick agent and air, a clean sealing surface will be maintained and there will be a tight seal with no gas leakage to cause an outside source of fire and air pollution, with all this being realized with less maintenance than necessary with conventional coke oven door constructions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A coke oven door mounted on a coke oven doorjamb, said door comprising, in combination:

(A) a main frame; and (B) seal means mounted on said main frame for providing a tight, uniform and non-sticking seal between said main frame and said oven doorjamb, said sealing means including a sealing knife edge element mounted on said main frame and arrangeable coextensive with said doorjamb; said sealing knife edge element extending cantilever fashion from said main frame to a free end of said edge element; and support means mounted on said main frame for exerting a uniform bias along an entire extent of said sealing knife edge element with said support means including a sealing edge support member anchored to and extending cantilever fashion away from said main frame and connected to said sealing knife edge element adjacent the free end of the edge element, the edge of said sealing edge support member applying a resilient force upon said free end of said sealing edge element and approaching the abuttable surface of said doorjamb at an angle of approximately 25 degrees said sealing knife edge element extending away from said main frame and terminating at an angle of approximately 25 degrees with respect to the abuttable surface of said doorjamb.

2. The structure as defined in claim 1, wherein said seal means further includes dispensing means for distributing a mixture of an anti-stick agent and air to all inner surfaces of said sealing means and to the surfaces of said jamb on which said door is mountable.

3. The structure as defined in claim 1, wherein said main frame includes, in combination:

a diaphragm directly overlying a portion of said sealing edge support member and extending around a periphery of said main frame; and lock means mounted on said main frame for locking said frame to said jamb, with said diaphragm being biasable uniformly against said jamb.

4. A structure as defined in claim 3, wherein said diaphragm is a leaf spring in the form of a substantially rectangular framework constructed from a resilient material.

5. The structure as defined in claim 1 and further wherein said seal means includes a dispensing means for distributing an anti-stick agent about said sealing knife edge element and said abuttable surface of said doorjamb.

6. The structure as defined in claim 5 wherein the dispensing means includes a dispensing manifold disposed about the periphery of said coke oven door and provided with a plurality of apertures, with said apertures being positioned to dispense said anti-stick agent against the inner surface of said knife edge element.

7. The structure as defined in claim 6 wherein said manifold comprises a length of hollow tubing.

8. The structure as defined in claim 1 wherein said support means sealing edge support member includes corrugations formed therein.

9. The structure as defined in claim 8 wherein said corrugations extend along said support member towards said knife edge element.

* * * * *